US006655338B2

(12) United States Patent
Tsubouchi et al.

(10) Patent No.: US 6,655,338 B2
(45) Date of Patent: Dec. 2, 2003

(54) AIR INTAKE MUFFLER AND OUTBOARD ENGINE ASSEMBLY HAVING THE SAME

(75) Inventors: Masanori Tsubouchi, Wako (JP); Tomonori Ikuma, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 10/068,430

(22) Filed: Feb. 6, 2002

(65) Prior Publication Data

US 2002/0104502 A1 Aug. 8, 2002

(30) Foreign Application Priority Data

Feb. 7, 2001 (JP) ..... 2001-030826
Feb. 8, 2001 (JP) ..... 2001-031904

(51) Int. Cl.[7] ..... F02M 35/10
(52) U.S. Cl. ..... 123/184.57
(58) Field of Search ..... 123/184.57, 572, 123/573, 198 E, 195 P, 195 C, 516; 440/88, 900, 89, 77; 181/229, 228

(56) References Cited

U.S. PATENT DOCUMENTS 5,673,675 A * 10/1997 Wada et al. ..... 123/572
5,913,295 A * 6/1999 Sadr et al. ..... 123/198 E
6,293,839 B1 * 9/2001 Tsunoda et al. ..... 440/88
6,383,044 B1 * 5/2002 Nemoto et al. ..... 440/77
6,485,342 B2 * 11/2002 Tsubouchi et al. ..... 440/88

FOREIGN PATENT DOCUMENTS

JP 08093433 4/1996
JP 145557 5/2002

* cited by examiner

*Primary Examiner*—Henry C. Yuen
*Assistant Examiner*—Hyder Ali
(74) *Attorney, Agent, or Firm*—Adams & Wilks

(57) ABSTRACT

An air intake muffler has an enclosure having a longitudinal axis, a first portion, and a second portion defining with the first portion an interior space of the enclosure. An air intake connecting duct is formed unitarily with the first portion of the enclosure and extends outwardly from the interior space of the enclosure. A pair of outside air intake ducts for introducing outside air into the interior space of the enclosure diverge in a V-shaped configuration from the longitudinal axis of the enclosure. Each of the outside air intake ducts has a pair of mating concave portions each formed unitarily with a respective one of the first and second portions of the enclosure and extending outwardly from the interior space of the enclosure.

31 Claims, 18 Drawing Sheets

AIR INTAKE MUFFLER AND OUTBOARD ENGINE ASSEMBLY HAVING THE SAME

FIELD OF THE INVENTION

The present invention relates generally to an air intake muffler (silencer) for an engine and, more particularly, to an air intake muffler for a vertical multi-cylinder engine for use in an outboard engine assembly.

BACKGROUND OF THE INVENTION

An air intake muffler (silencer) of this kind is disclosed in, for example, Japanese Patent Laid-Open Publication No. HEI-8-93433. The air intake muffler has an overall box shape which is composed of a flat base plate, a plurality of air horns mounted on the base plate so as to protrude toward the inside of the box, and a case covering the base plate. The base plate and the case are joined to one another in a unitary structure to form the box shape. The air horns form air intake connecting passages which communicate with a throttle of the engine. Since outermost surfaces of the air horns are flat, a difficulty is encountered in connecting a terminal end portion of the air intake passage or path of the throttle valve unit to the air horns and in sealing the joint portions, with a resultant difficulty in ensuring a sealing property in high precision.

Further, since the air horns are so arranged as to protrude in an internal space of the air intake muffler to allow the same to be connected to the air intake passage of the throttle valve unit in an easy and reliable manner, although it is thinkable to provide fitting-type joint portions to the outermost surfaces of the air horns, the base plate of the air intake muffler becomes complicated in structure causing intricate and troublesome manufacturing processes.

Furthermore, although there is a need for locating an outside air intake opening, in addition to the air intake connecting passage, in the air intake muffler and the prior art practice contemplates the provision of apertures in the box-shaped air intake muffler, the use of the apertures encounter a problem in view of an air intake efficiency. As a consequence, it is preferable for a cylindrical member to be incorporated in order to obtain a tube-length effect (wherein induction noise, generated by vibration of air caused during air sucking, is substantially determined by the dimension of the intake pipe), with a resultant increase in the number of component parts causing the need for providing a sealing structure between the cylindrical member and the air intake muffler, resulting in an additional increase in the number of component parts, a complicated structure and an increased cost.

In the outboard engine assembly, further, since the air intake muffler is mounted to one of areas in fore and aft directions of the vertical type engine with a vertical crankshaft, the outboard engine assembly involving the engine is largely sized in structure in fore and aft directions.

SUMMARY OF THE INVENTION

It is therefore an object of the present invention to provide an air intake muffler which is unitarily formed with a cylindrical outside air intake opening having a cylindrical joint opening, to be connected to a throttle valve unit, and a tube-length effect without requiring additional component parts in manufacturing stages of a box-shaped muffler body.

According to a first aspect of the present invention, there is provided an air intake muffler for introducing outside air to feed the same to an air intake passage of a throttle valve unit of an engine, which muffler comprises a box body, an air intake connecting duct adapted to be connected to the air intake passage, and at least one outside air intake duct for introducing the outside air into the box body, wherein the box body includes two halves by one of which the air intake connecting duct is unitarily formed so as to protrude outwardly, and the outside air intake duct is formed by mating concave portions to one another which are unitarily formed with both of the two halves so as to protrude outwardly.

The box-shaped air intake muffler body is able to be unitarily formed with the air intake connecting duct, to be connected to the throttle valve unit, and the outside air intake duct without the need for additional component parts except for the upper and lower halves in stages of manufacture of the air intake muffler body by allowing dish-shaped two halves to be mated to and jointed to one another. As a consequence, manufacture can be easily performed without need for additional component parts, with a resultant decrease in the number of component parts while cutting costs.

Further, the body of the air intake muffler is formed into dish-shaped two halves, one of which is unitarily formed with the air intake connecting duct and the other one of which is unitarily formed with the concave portion which forms a remaining half of the outside air intake duct. Accordingly, during manufacture of the air intake muffler, merely jointing the halves to one another by means of adhesion or screw tightening, etc, enables the air intake muffler, having the air intake connecting duct and the outside air intake duct, to be easily manufactured.

Furthermore, since the air intake connecting duct and the outside air intake duct are unitarily formed with the body of the air intake muffler, there is no need for the muffler body, and the air intake connecting duct and the outside air intake duct to be sealed off.

The outside air intake duct of the air intake muffler includes, for example according to examples of the preferred embodiments, two components, with these two outside air intake duct components being formed in a V-shaped configuration so as to diverge rearwardly. Thus, the presence of two outside air intake ducts whereas a single air intake connecting duct to be connected to the throttle valve unit is provided improves air intake efficiency with favorable reduction in induction noises.

The two halves are composed of upper and lower half components, and the air intake connecting duct and the outside air intake duct are located in a horizontal direction. Thus, the presence of the air intake connecting duct and the outside air intake duct extending in the horizontal direction enables the height of the air intake muffler to be limited to a minimum value to allow, for example, the use of the air intake muffler for the outboard engine assembly for thereby making it possible to miniaturize the outboard engine assembly.

One of the two halves of the air intake muffler is formed with a retaining frame at a position wherein the air intake connecting duct is formed to allow a peripheral edge of a flame arrester, which is composed of a mesh member, to be inserted in the retaining frame such that the flame arrester is mounted in the retaining frame. During the course of mating and jointing the two halves to one another, it is possible for the air intake muffler to be easily manufactured under a condition wherein the mesh member, which forms the flame arrester mounted to the retaining frame formed in one of the halves, is internally incorporated. The flame arrester is mounted in the retaining frame in a plane perpendicular to an axis of the air intake connecting duct.

According to a second aspect of the present invention, there is provided an outboard engine assembly which comprises an engine, and an air intake muffler located above the engine and including an air intake connecting duct connected to an air intake passage of a throttle valve unit of the engine, and at least one outside air intake duct for introducing outside air.

In the thus arranged outboard engine assembly, presence of the air intake muffler located above the engine allows an upper surface of the engine to be effectively utilized. According to the preferred embodiments, for example, the engine comprises a V-type multi-cylinder vertical engine wherein the air intake muffler having a substantially flat bottom wall is placed above a drive pulley, driven by a crankshaft of the engine, and a belt engaging the drive pulley. That is, since the air intake muffler is located above the belt, etc. which is positioned above the engine, the belt and the engine are opened at their side areas to provide an improved heat dissipating property of the belt and the engine.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
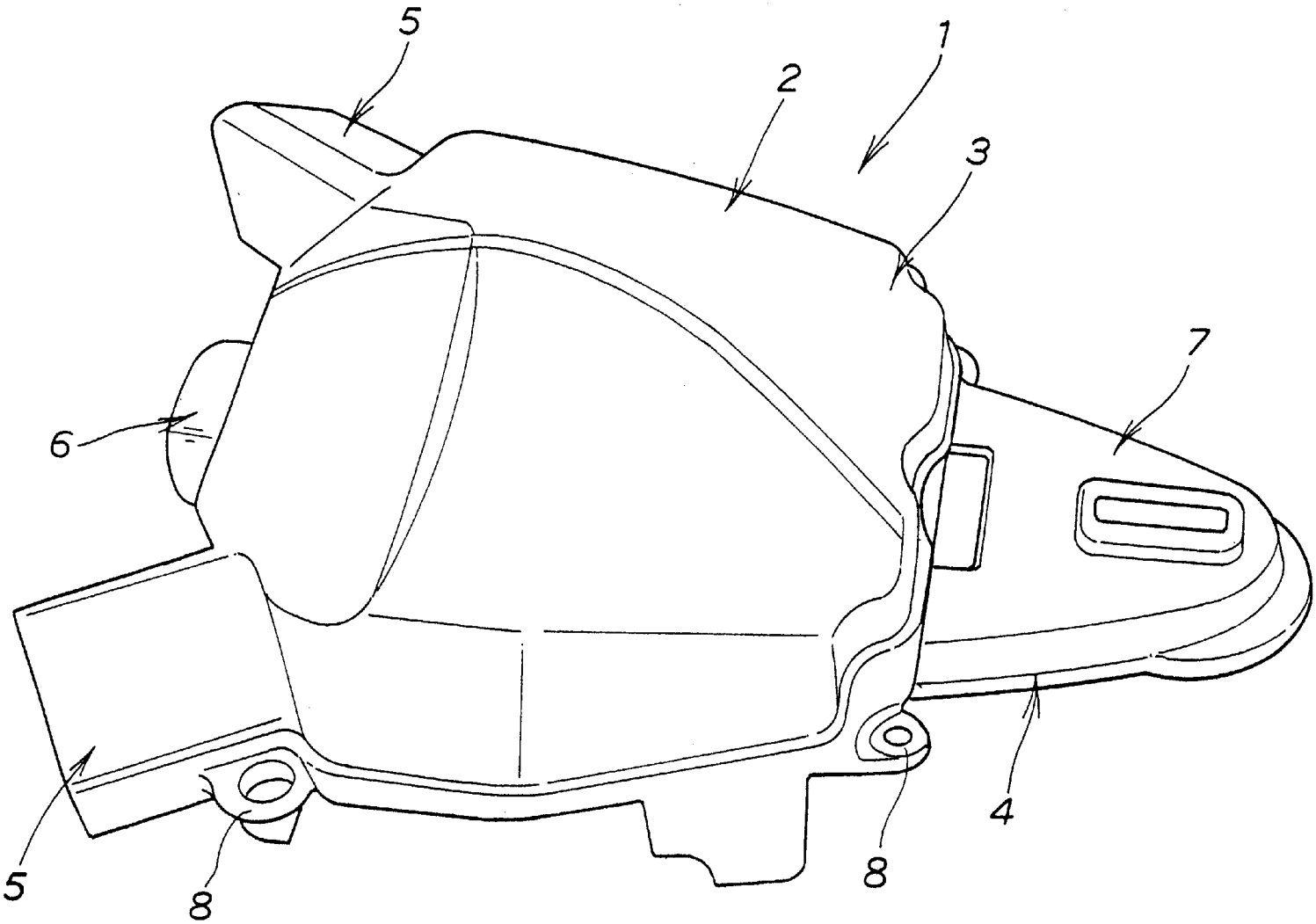
FIG. 1 is a perspective view of an air intake muffler according to a first embodiment of the present invention.
Figure 14:
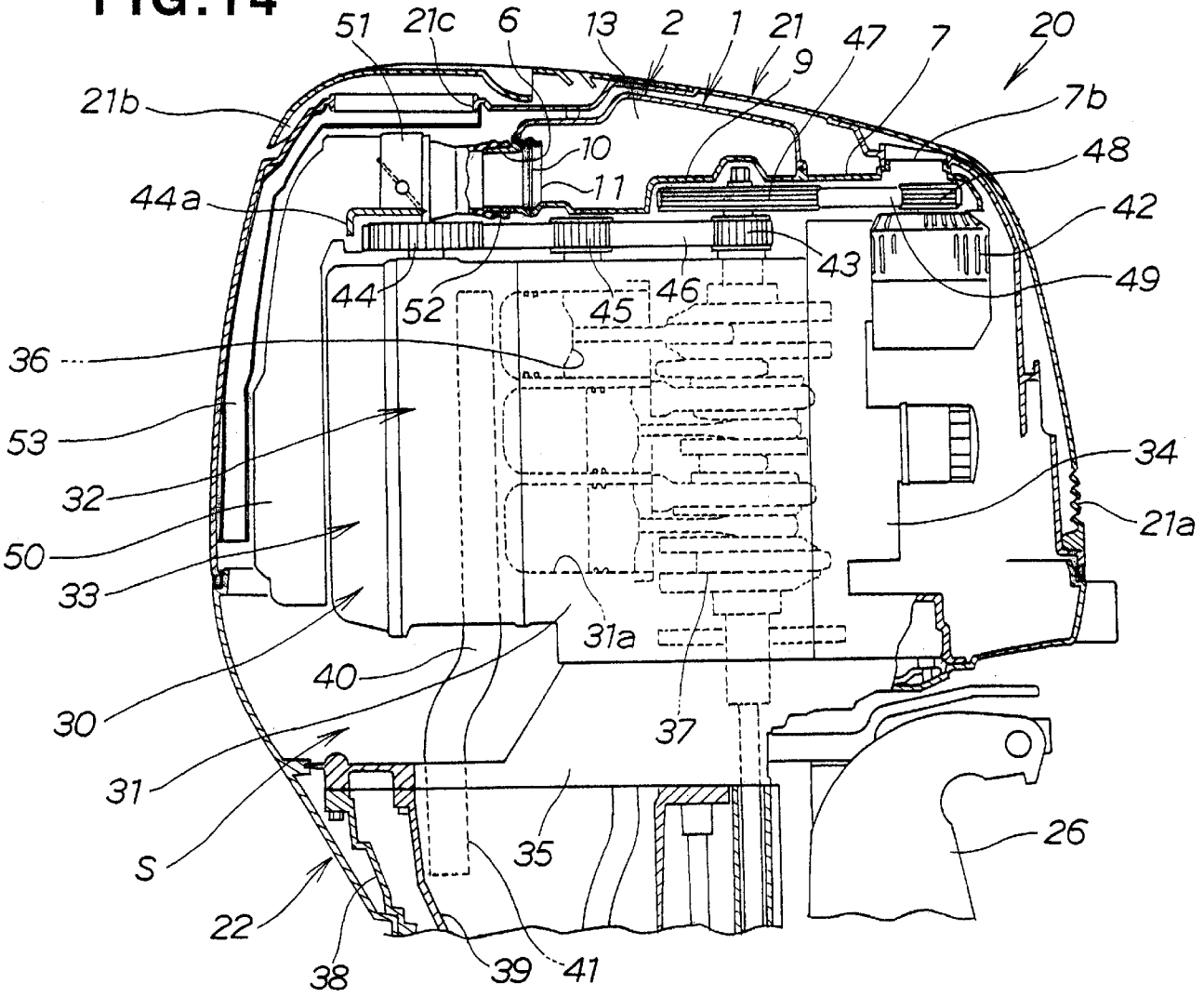
FIG. 14 is an enlarged view of the outboard engine assembly shown in FIG. 13 with an upper part thereof cut away.

An air intake muffler 1 shown in FIG. 1 is used as an air intake muffler of an engine of an outboard engine assembly as shown in FIG. 14 and is located above a V-type multi-cylinder vertical engine with its crankshaft extending in a vertical direction. A body 2 of the air intake muffler 1 has a flat thin type box-shaped configuration and includes upper and lower halves 3, 4.

The muffler body 2 has two outside air intake ducts 5, 5 for introducing outside air, and an air intake connecting duct 6 for delivering outside air, which is introduced, into the engine. The two outside air intake ducts 5, 5 extend rearward from both rear portions of the body 2 in a V-shape spreading direction. The air intake connecting duct 6 is formed at an intermediate portion of a lengthwise rear area of the body 2 so as to open rearwardly (in a direction opposed to a direction in which the outboard engine assembly is propelled).

Figure 3:
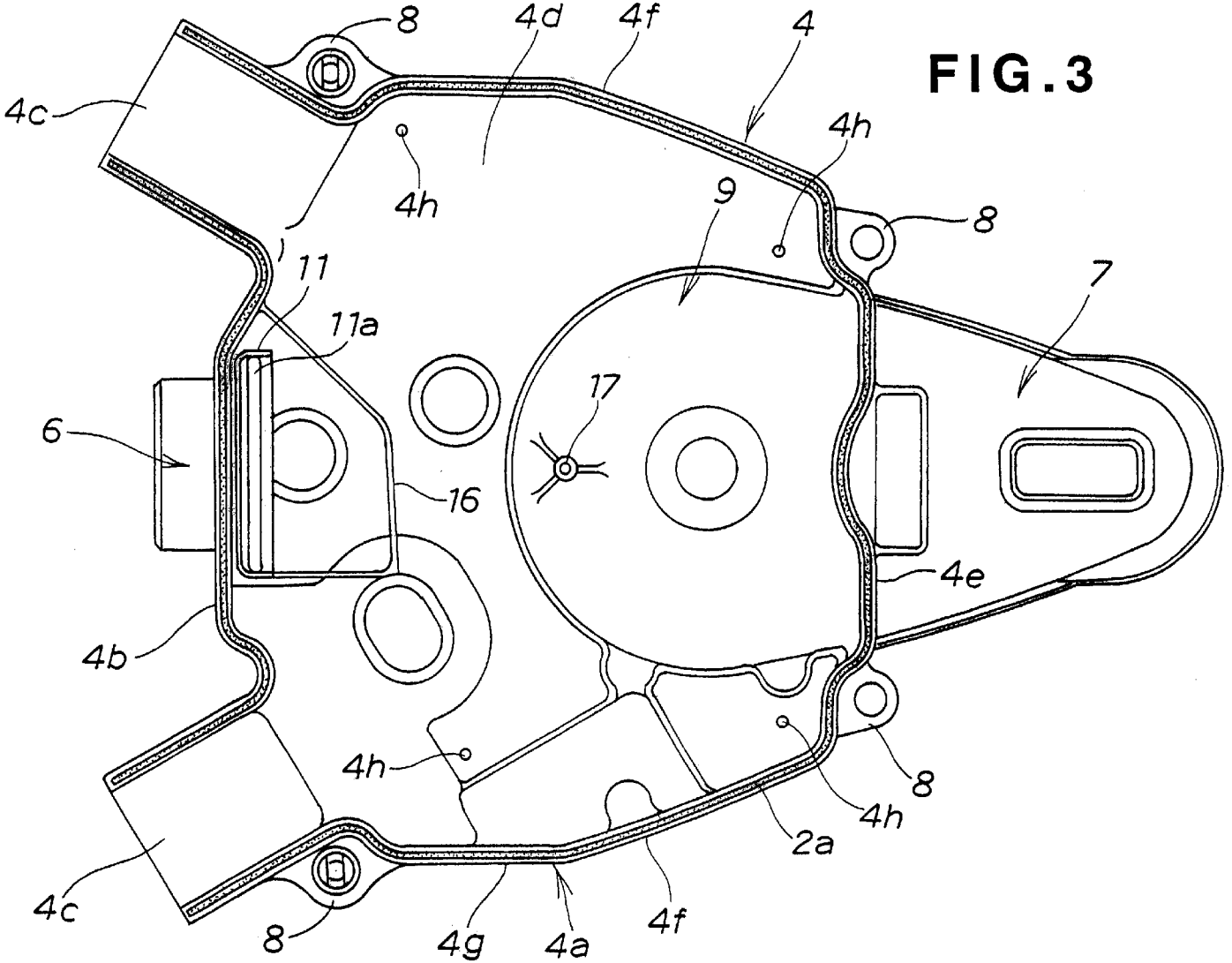
FIG. 3 is a plan view of a lower half of the air intake muffler shown in FIG. 2.

The lower half 4 has a cover section 7 which protrudes forward from a front area of the upper half 3. The lower half 4 has four mount stays 8 as shown in FIG. 3. Each of the stays 8 has a mount bore.

Figure 2:
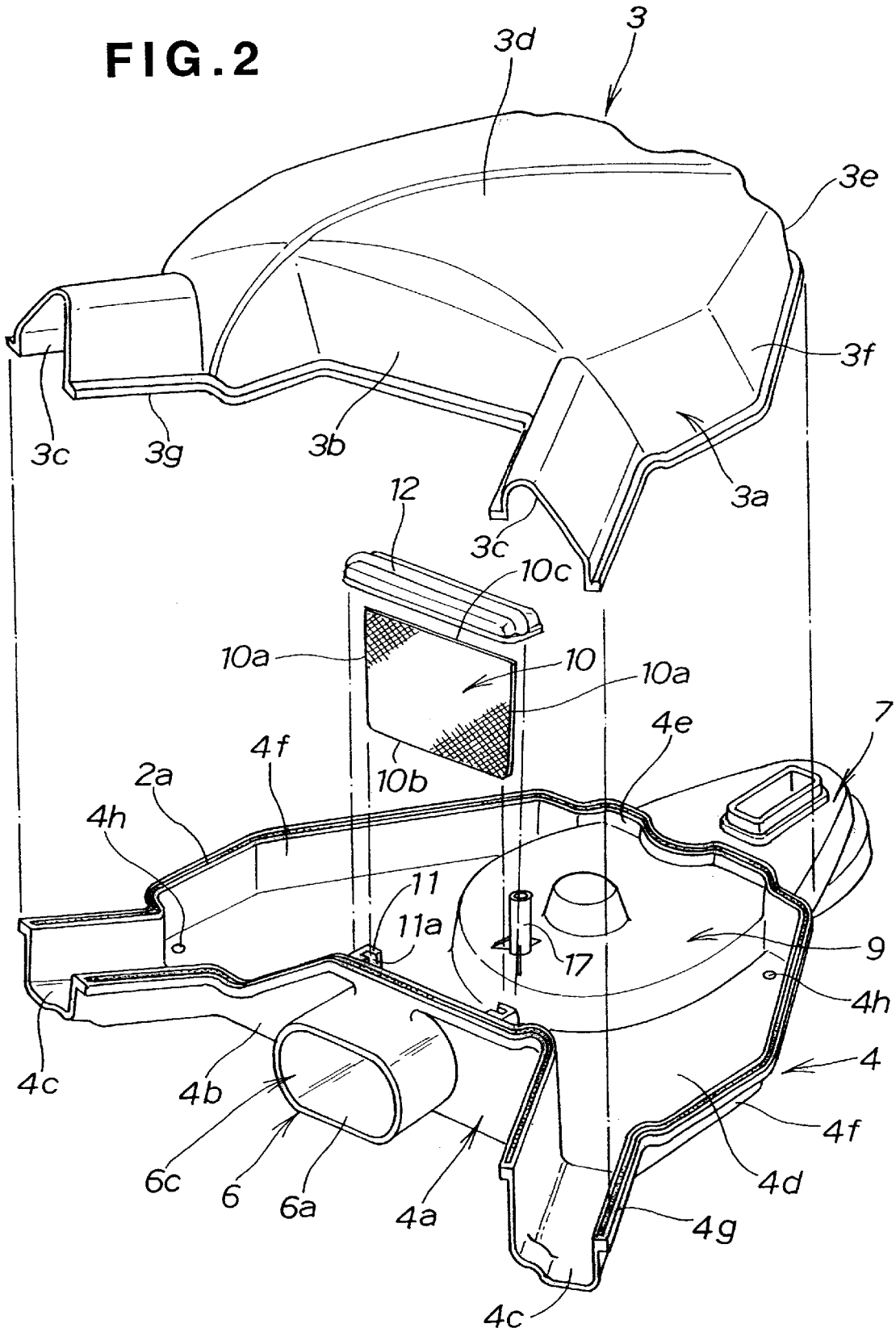
FIG. 2 is an exploded perspective view of the air intake muffler shown in FIG. 1.

FIG. 2 shows the intake air muffler in an exploded state of the upper and lower halves 3, 4.

Figure 6:
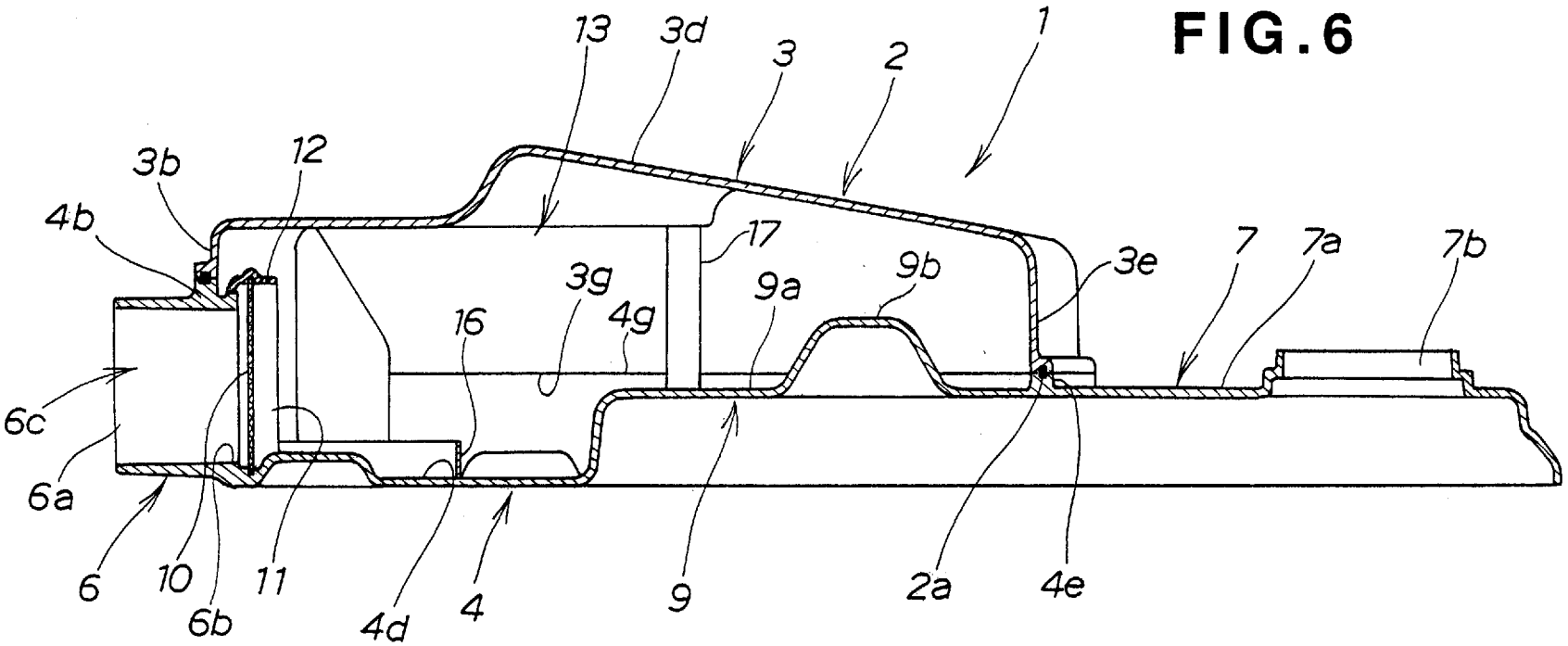
FIG. 6 is a cross sectional view taken on line 6—6 of FIG. 4.

The lower half 4 has an outer periphery surrounded with an upright wall 4*a* to form a dish-shaped configuration. An intermediate area of a rear wall 4*b* which forms a part of the upright wall 4*a* is formed with the air intake connecting duct 6 which has a cylindrical structure formed in an oblong configuration with a lateral longitudinal axis lying in a horizontal plane. An intake air passage of the air intake connecting duct 6 communicates with the inside of the lower half . As shown in FIG. 6, the air intake connecting duct 6 has an upstream opening 6*b* formed in the rear wall 4*b*, and a downstream opening 6*c* whose rear distal end is opened.

Further, the rear wall 4*b* of the lower half 4 is formed with two gutter-shaped concave portions 4*c*, 4*c*. The concave portions 4*c*, 4*c* form gutter portions. The concave portions 4*c*, 4*c* are formed at boundary areas between both sides of the rear wall 4*b* and right and left side walls 4*f*, 4*f* to allow the inside and the outside of the dish-shaped lower half 4 to communicates with one another.

A front half of a bottom portion 4*d* of the lower half 4 is formed with an embossed portion 9 which is embossed upward in a semicircular configuration, as viewed in a plane, with a front area of the embossed portion 9 facing a laterally extending front wall 4*e* which is contiguous with the right and left side walls 4*f*, 4*f*.

The upper half 3 has a symmetrical shape with the lower half 4 to have a suspended wall 3*a* which suspends from a periphery of a ceiling portion 3*d* to surround the same and is formed in a reversed dish-shaped configuration. Both sides of a rear wall 3*b* the suspended wall 3*a* are formed with concave portions 3*c*, 3*c* composed of downwardly facing gutter-shaped portions, which are reversed in structure, so as to meet with the associated concave portions 4*c*, 4*c* of the lower half 4. The concave portions 3*c*, 3*c* are formed at boundary areas between right and left ends of the rear wall 3*b* and right and left ends of the side walls 3*f* so as to protrude rearward. The bottom portion 4*d* of the lower half 4 is formed with four drain ports 4*h* as shown in the drawing. The drain ports 4*h* serve to drain water entering with outside air through the outside air intake ducts 5, 5. Further, as shown in FIG. 3, a water entry block plate 16 is formed at an upstream side of the air intake connecting duct 6 to preclude water, which has entered from the outside air intake ducts 5, 5, from being delivered to the air intake connecting duct 6. The water entry block plate 16 functions as a dam.

The upper and lower halves 3, 4 are mated to and joined to one another to form a unitary structure. For example, a lower edge portion 3*g* of the suspended wall 3*a* of the upper half 3 is brought into abutting engagement with an upper edge portion 4*g* of the upright wall 4*a* of the lower half 4 via a seal member 2*a* and is adhered thereto by an adhesive. In place of the adhesive, the mated portions may be deposited to one another by vibrating deposition or may be fixed to one another by bolts if desired. The lower half 4 has a strut 17. The presence of the strut 17 allows the upper and lower halves 3, 4 to resist the pressure exerted in a vertical direction and has a structure which prevents deformation while reducing vibrations and noises caused during air intake. Mating and jointing the upper and lower halves 3, 4 to one another allows the concave portions 3*c*, 3*c* formed in the upper half 3 and the concave portions 4*c*, 4*c* formed in the lower half 4 to be overlapped with one another, forming the air intake ducts 5, 5 as shown in FIG. 1.

When mating and jointing the upper and lower halves 3, 4 with each another, a mesh member 10 serving as a frame arrestor is interposed.

As shown in FIGS. 2 and 3, a retaining frame 11, which has a concave type structure, as viewed in a plane, composed of three frame components such as lower frame component and both sidewise frame components, is located at an area inside the rear wall 4*b* of the lower half 4 and upstream of the air intake connecting duct 5. A continuous engaging recess 11*a* is formed inside the three frame components of the retaining frame 11. The mesh member 10 is formed of metal, for example, stainless steel wires, and has a rectangular plate configuration with a lateral longitudinal axis lying in the horizontal plane in the illustrated preferred embodiment. The mesh member 10 is inserted downward from the above in the engaging recess 11*a* of the retaining frame 11 along with the right and left side edge portions 10*a*, 10*a* and a lower edge portion 10*b*. And, an oblong cap-shaped press member 12 is put on an upper edge 10*c* of the mesh member 10 to fixedly secure the mesh member 10 to the retaining frame 11 in place.

Figure 4:
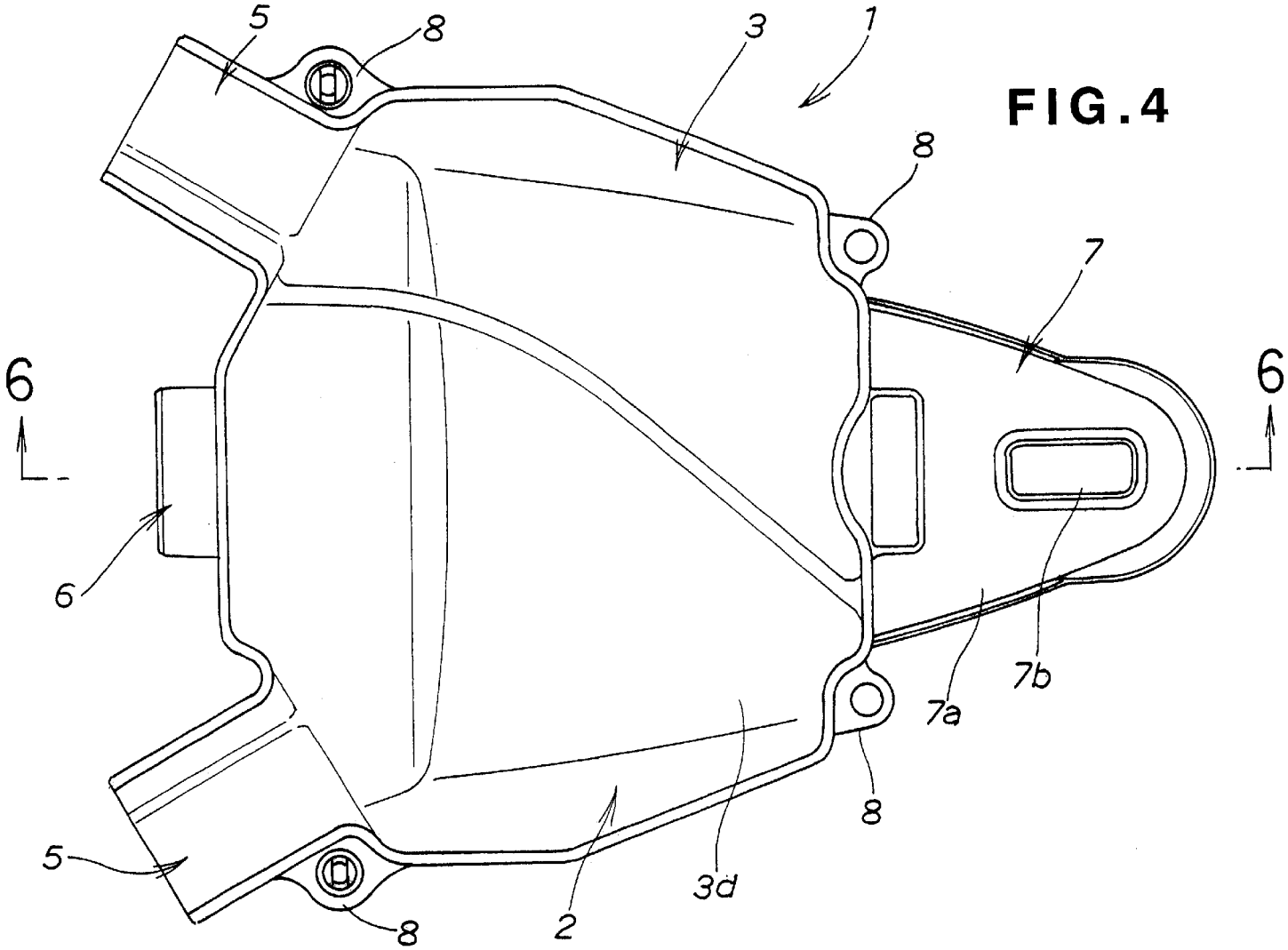
FIG. 4 is a plan view of the air intake muffler shown in FIG. 1.
Figure 5:
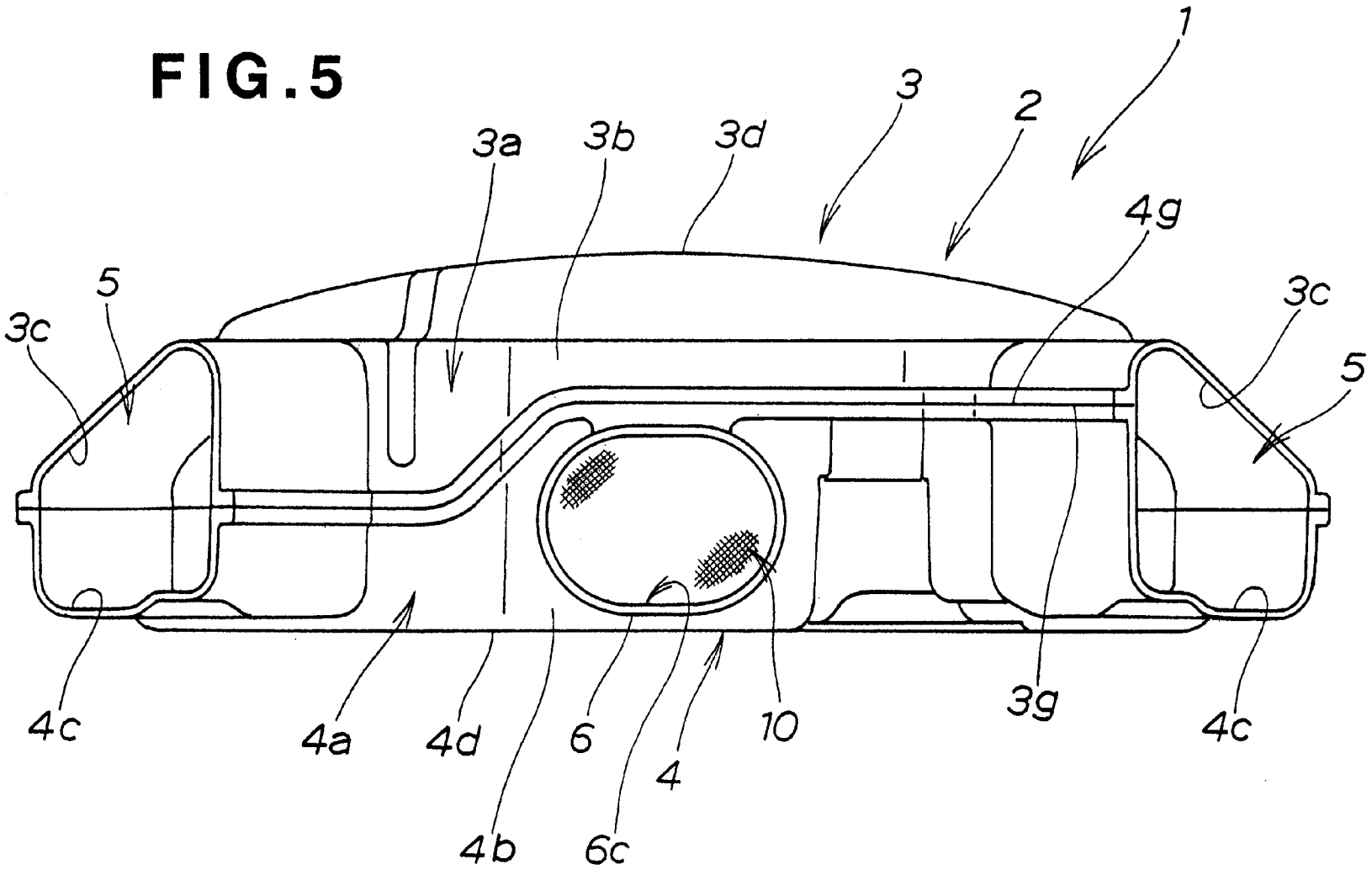
FIG. 5 is a front view of the air intake muffler shown in FIG. 1.

As shown in FIGS. 4 to 6, a front half portion of an intermediate section, in width wise direction, of the bottom portion of the lower half of the muffler body 2 is formed with the embossed portion 9 shaped in a semicircular configuration, as viewed in a plane, which upwardly extends from the bottom portion 4*d* as previously described above. The front portion of the lower half 4 has a cover portion 7 which extends forward in a unitary structure.

The ceiling 9*a* of the embossed portion 9 and a ceiling 7*a* of the cover portion 7 are contiguous in the same plane. A central portion of the ceiling 9*a* of the embossed portion 9 is formed with a protruding portion 9*b* which extends upward. A front portion of the ceiling 7*a* of the cover portion 7 is formed with a ventilation opening 7*b*.

When mounting the air intake muffler 1 to the upper area of the engine, the embossed portion 9 and the cover portion 7 serve to avoid interference with the belt with respect to a height thereof. Thus, a need for miniaturization of an overall structure of an engine room is satisfied. Further, the presence of the air intake muffler 1 located above the belt allows a belt cover to be dispensed with.

The muffler body 2 internally defines an air intake muffler chamber 13. The air intake muffler chamber 13 communicates with the air intake passage of a throttle valve unit via the air intake connecting duct 6 and also communicates with the outside via the outside air intake ducts 5, 5.

Figure 7:
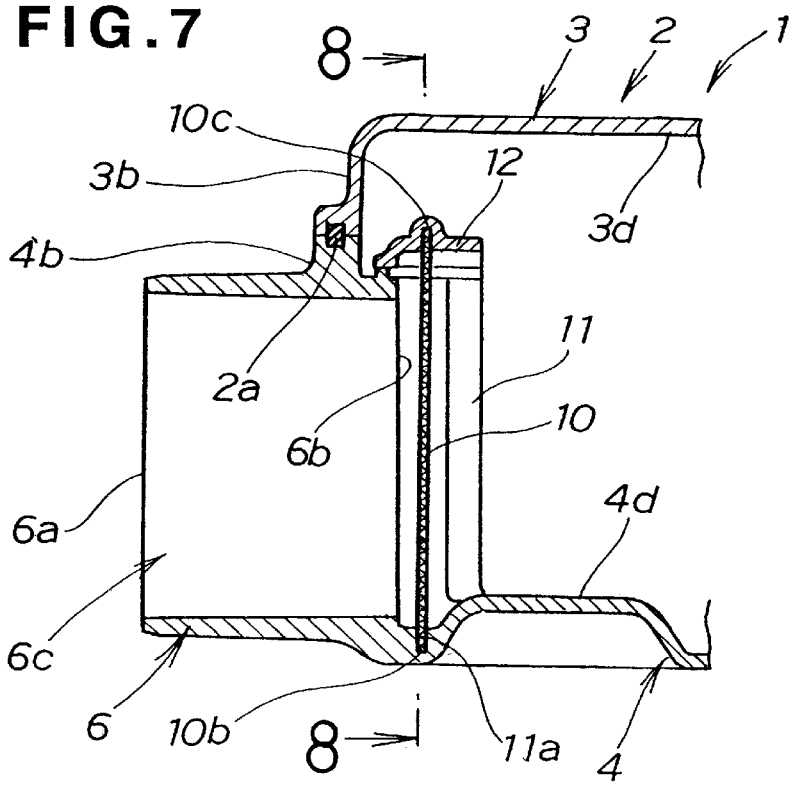
FIG. 7 is an enlarged cross sectional view illustrating a retaining structure of a mesh member shown in FIG. 6 in detail.
Figure 8:
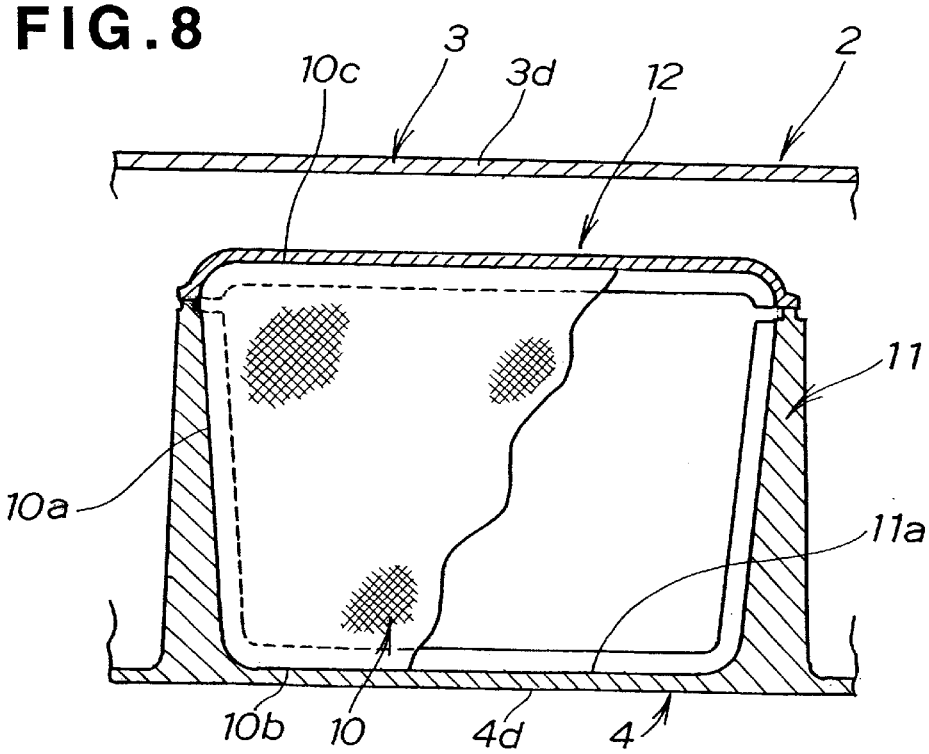
FIG. 8 is a cross sectional view taken long a line 7—7 of FIG. 7.

Referring now to FIGS. 7 and 8 which illustrate the mount structure of the mesh member 10 in detail, the retaining fame 11 of the mesh member 10 is located in the vicinity of the upstream opening 6*b* so as to surround the right and left and lower areas of the upstream opening 6*b* formed at the rear wall 4*b* of the lower half 4, with the upper area being open to form the concave configuration as viewed in FIG. 7. The engaging recess 11*a*, through which the mesh member 10 is inserted, is formed inside the retaining frame 11. The both side frame components of the retaining frame 11 of the concave configuration are slanted so as to spread in an upward direction. Thus, if the spread area of the upper side is wider than that of the bottom side, it becomes easy for the mesh member 10 to be inserted in the retaining frame 11.

After the mesh member 10 is inserted such that the right and left side edge portions 10*a*, 10*a* of the mesh member 10 engage the engaging recess 11*a* of the retaining frame 11, the press member 12 is put on the upper edge portion 10*c* of the mesh member to retain the mesh member 10 in place. The right and left slide edge portions 10*a*, 10*a* of the mesh member 10 are shaped in a downwardly narrowed profile so as to cope with the shape of the retaining frame 11. This results in a protection of looseness, along with the inclination of the retaining frame 11, that would occur after the mesh member 10 has been mounted.

Thus the mesh member 10, which forms the flame arrester is assembled in the course of overlapping the upper and lower halves 3, 4 to one another.

Figure 9:
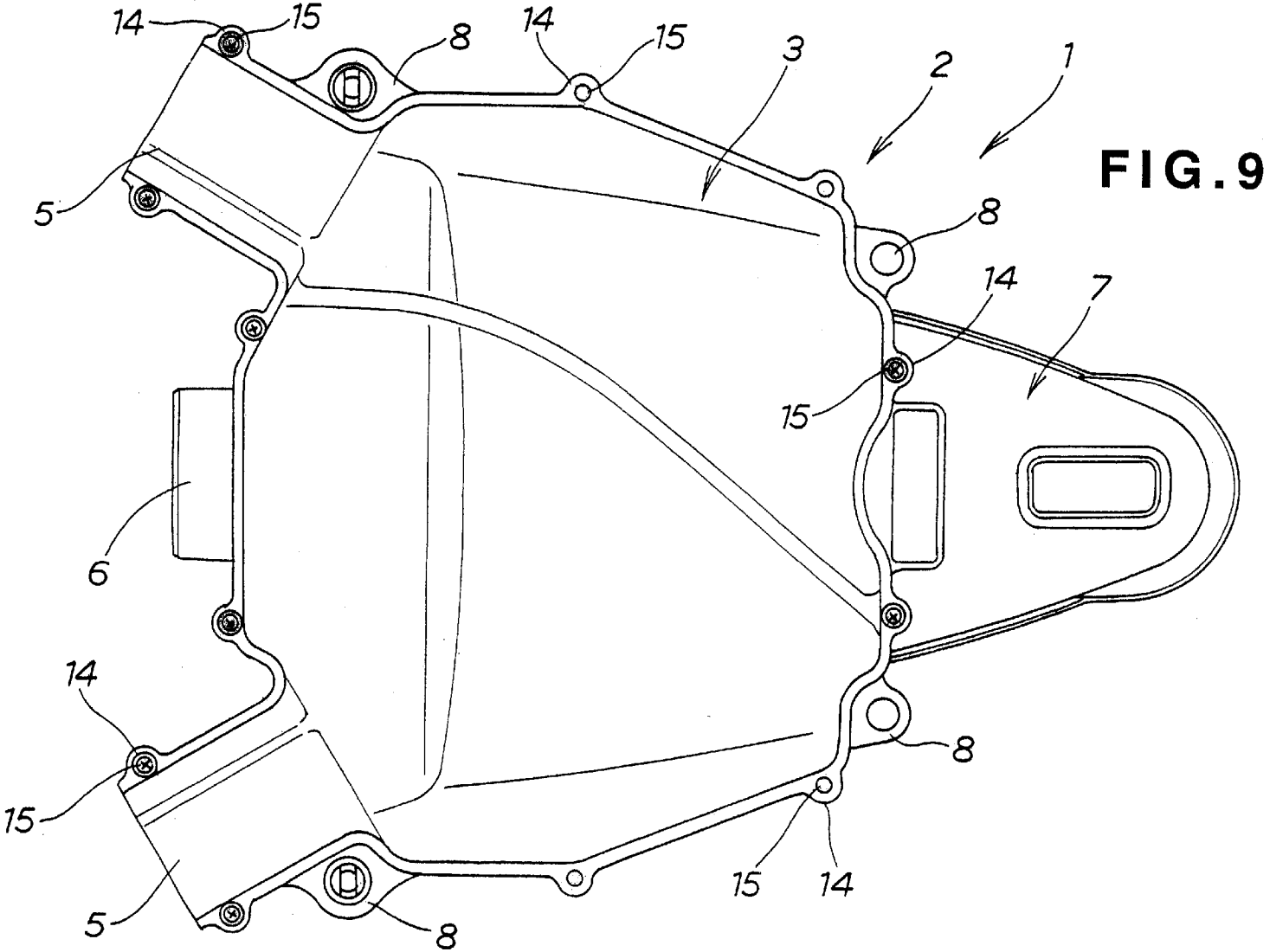
FIG. 9 is a plan view illustrating a modified form of the air intake muffler.
Figure 10:
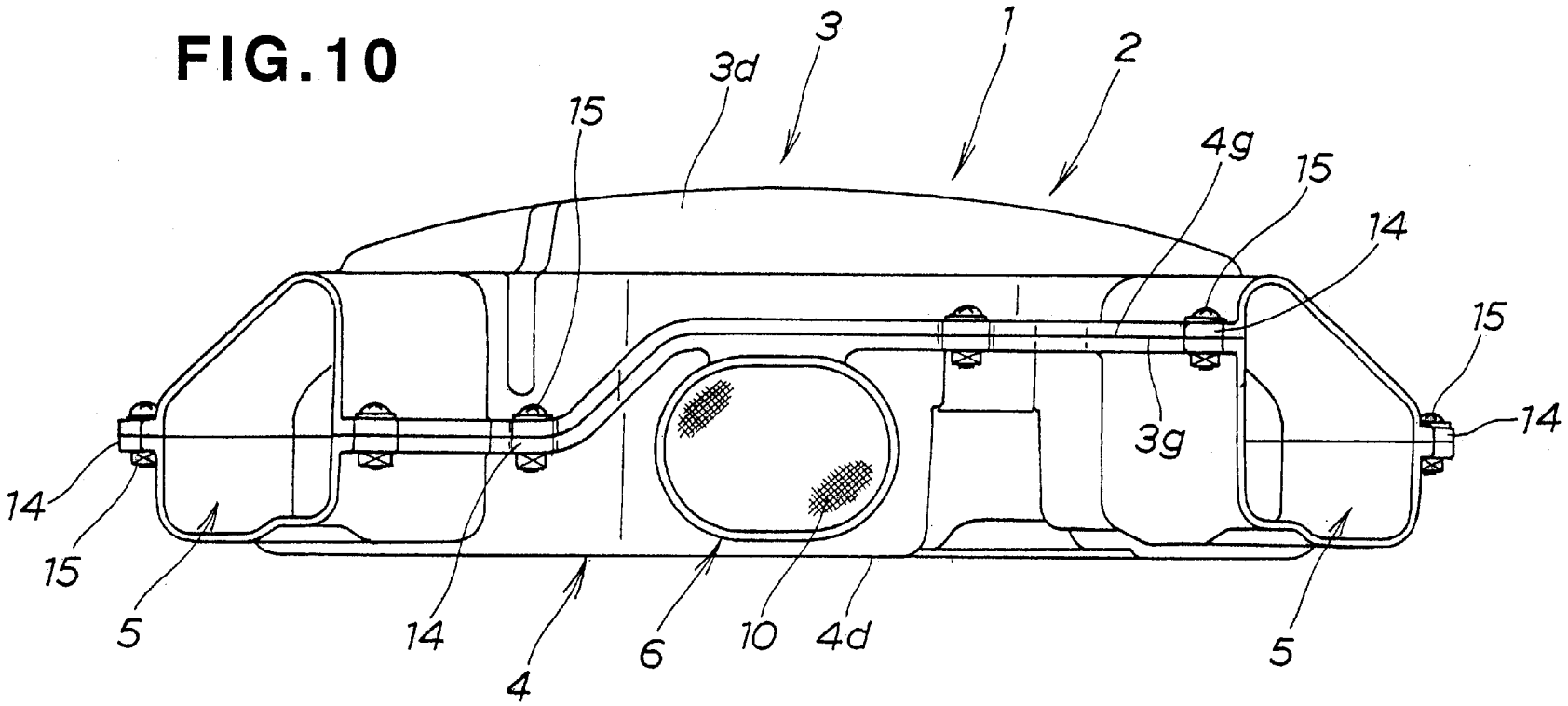
FIG. 10 is a front view of the air intake muffler shown in FIG. 9.

FIGS. 9 and 10 show a modified form of the air intake muffler of the first preferred embodiment according to the present invention.

In the modified form, when jointing the upper and lower halves 3, 4 to one another to form the unitary structure, the edge portions 3*g*, 4*g*, which form the joint portions of the upper and lower halves 3, 4, are formed at pluralities of locations formed with boss portions 14 through which screws 15 are inserted and are tightened to allow the edge portion 3*g* of the upper half 3 and the edge portion 4*g* of the lower half 4 to be joined to one another. Thus, in addition to the adhesion and deposition technologies, or in place thereof, the upper and lower halves 3, 4 may be joined together by screws into the unitary structure. During such operation, the presence of the screws 15 arranged to be tightened in the same direction provides an improved workability and the presence of an arbitrary one of the screws 15 arranged to be tightened in a direction different from those of the other screws enables an assembling sequence to be standardized.

Figure 11:
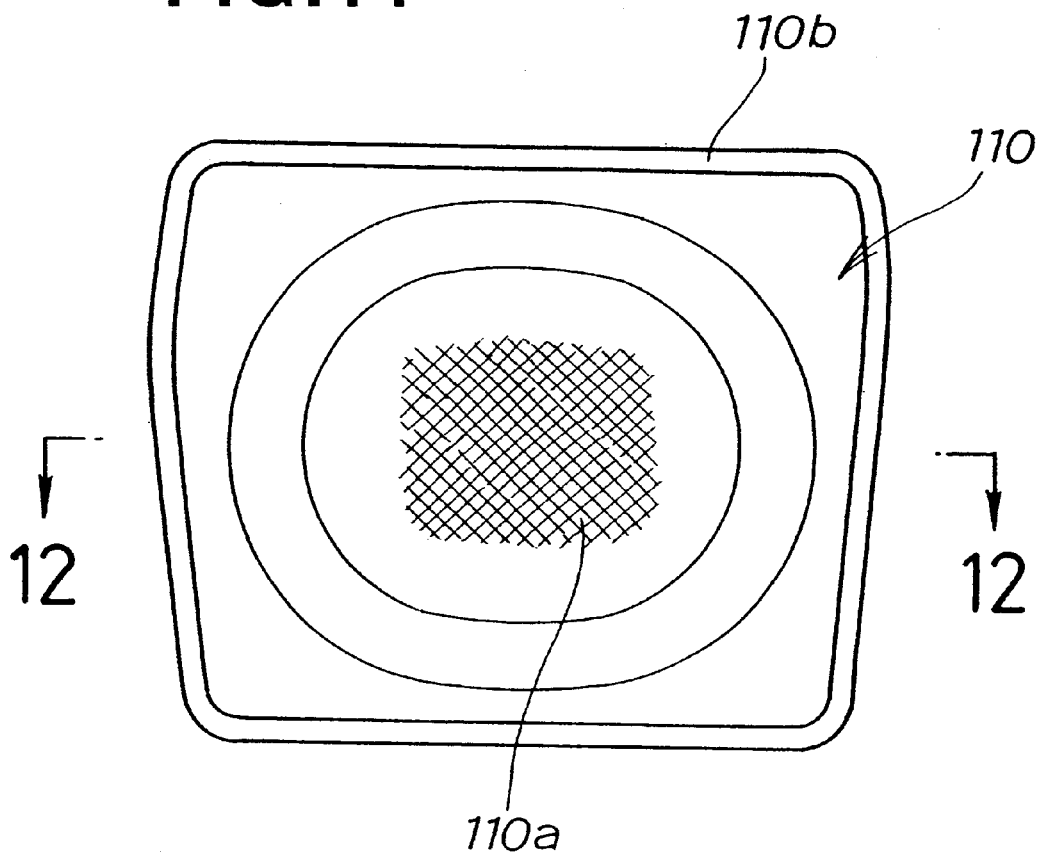
FIG. 11 is a front view illustrating another example of the mesh member shown in FIG. 9.
Figure 12:
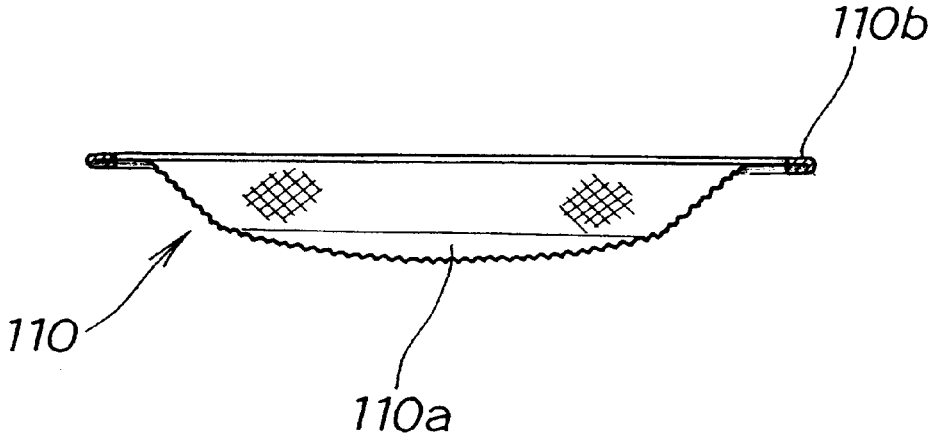
FIG. 12 is a cross sectional view taken on line 12—12 of FIG. 11.

FIGS. 11 and 12 show a mesh member of another preferred embodiment. The mesh member 110 of this preferred embodiment includes a mesh body 110*a* which is made of stainless steel wires which are woven to expand at a central area. A peripheral portion of the mesh body 110*a* is retained with a frame member 110*b*. The mesh member 110 of this preferred embodiment also has a shape wherein right and left side edge portions are downwardly narrowed as that of the preferred embodiment described above, thereby precluding looseness, along with the inclination of the retaining frame 11, that would occur after the mesh member 110 has been mounted.

Now, an outboard engine assembly, which is mounted with the air intake muffler according to the present invention, is described below with reference to FIGS. 13 to 18. The outboard engine assembly shown in the drawings includes a vertical engine of the V-type multi-cylinder.

Figure 13:
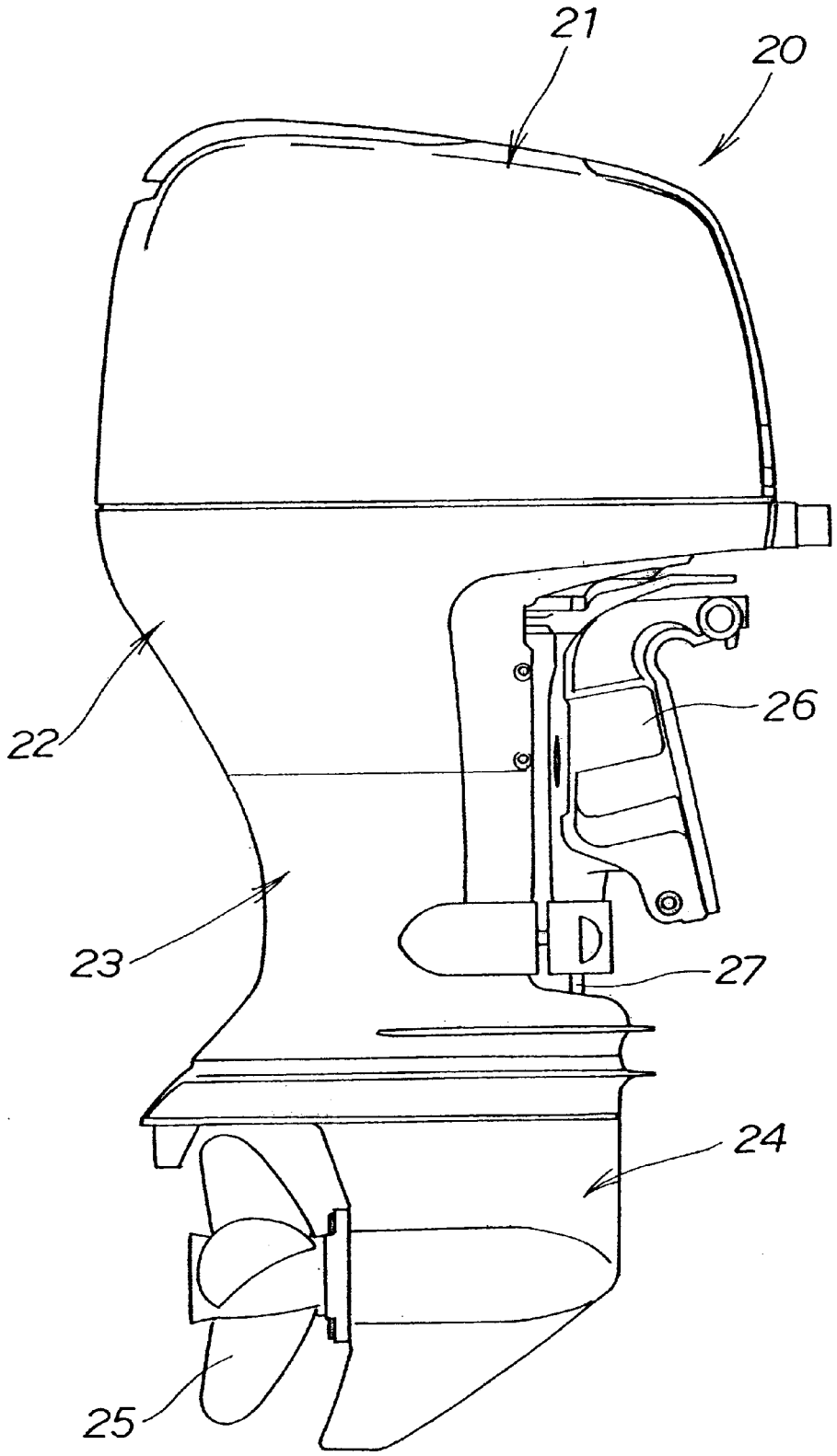
FIG. 13 is a side view of an outboard engine assembly.

In FIG. 13, the outboard engine assembly 20 includes an upper engine cover 21, an under cover 22 located below the engine cover 21, an extension case 23 located below the under cover 22, and a gear case 24 located below the extension case 23.

A screw 25 is mounted at a rear end of the gear case 24. At a front portion between the under cover 22 and the extension case 23, a stern bracket 26 is mounted to be rotatable about a swivel axis 27.

As shown in FIG. 14, the engine cover 21 covers the engine 30 and accessories and defines an engine room S.

The engine 30 includes a cylinder block 31, a cylinder head 32, a cylinder head cover 33, a crankcase 34, a piston 36 and a crankshaft 37, and is mounted on a mount case 35.

The cylinder block 31 has a plurality of cylinders 31*a* which are arrayed in a vertical direction. The cylinder head 32 is located rearward of the cylinder block 31. The cylinder head cover 33 is located rearward of the cylinder head 32. The crankcase 34 is located at a front of the cylinder block 31.

The mount case 35 is supported with the extension case 38 which is covered with the under cover 22. An oil pan 39 is located inside the extension case 38.

An exhaust port of the cylinder head 32 is connected to an exhaust manifold 40. The exhaust manifold 40 is connected to an exhaust pipe 41. The exhaust pipe 41 extends downward and expels exhaust gases downward of the extension case 23 shown in FIG. 13.

An alternating current electric power generator (ACG) 42 is mounted at an upper area of the front portion of the crankcase 42. A pulley 43, which is driven with the crankshaft 37, and a drive pulley 47 for driving the electric power generator are located at an upper area of the cylinder block 31. A camshaft drive pulley 44 is located at the upper area of the cylinder head 32. The drive pulley 43 and the camshaft drive pulley 44 are drivably coupled to one another via an intermediate tension pulley 45 for driving the camshaft. An upper side of the camshaft drive pulley 44 is covered with a pulley cover 44*a*. The air intake muffler 1 according to the present invention is located above the tension pulley 45, the drive pulley 43, the drive pulley for the electric power generator and the electric power generator pulley 48.

The timing belt 46 is located so as to have a narrow width (in a lateral width) in a right and left direction in the engine room S by means of the plurality of tension pulleys 45, 45, 55, thereby ensuring a space between the both sides of the lower area of the air intake muffler 1 and the upper area of the engine 30. Accordingly, air is discharged from the side areas between the upper area of the engine and the air intake muffler, contributing to a heat dissipating property of the belt/pulley mechanism. Further, the presence of the intake air muffler allows covers for the pulleys 43, 45, 47 except for the camshaft drive pulley 44 to be dispensed with.

The crankshaft 37 is mounted with an electric power generator drive pulley 47 of a larger diameter than the drive pulley 43. A timing belt 49 extends between the electric power generator drive pulley 47 and an electric power generator driven pulley 48 for driving the electric power generator 42.

An intake manifold 50 is mounted at a rear area of the cylinder head cover 33. A throttle valve unit 51 is mounted at an upper area of the intake manifold such that an air intake passage has an upstream portion orientated forward.

The air intake muffler 1 is located above the cylinder block 31 and the crankcase 34. The body 2 of the air intake muffler 1 is mounted to the engine side by means of the plurality of mount stays 8. The electric power generator drive pulley 47 of the larger diameter is located below the embossed portion 9 formed in the bottom portion of the body 2 of the air intake muffler 1. The driven pulley 48 of the electric power generator 42 is located below the ventilation opening 7*b*. The embossed portion 9 and the cover portion 7 form a cover member for the electric power generator drive pulley 47 and the driven pulley 48.

The air intake connecting duct 6 formed at the rear area of the box-shaped air intake muffler 2 is connected to the throttle body which forms the air intake passage of the throttle valve unit 51.

Connection between the air intake passage of the throttle unit 51 and the air intake connecting duct 6 is performed by means of a grommet 52 by compelling a cylindrical portion of the air intake connecting duct 6 to be mated with the air intake passage. Thus, the connecting portion is easily and reliably sealed.

A front portion of the engine cover 21 is formed with a coolant air intake port 21*a*. An upper and rear portion of the engine cover 21 is formed with an outside air intake port 21*b* to allow an internal intake opening 21*c* to introduce outside air through a duct 53 into the engine room S defined with the engine cover 21.

Figure 15:
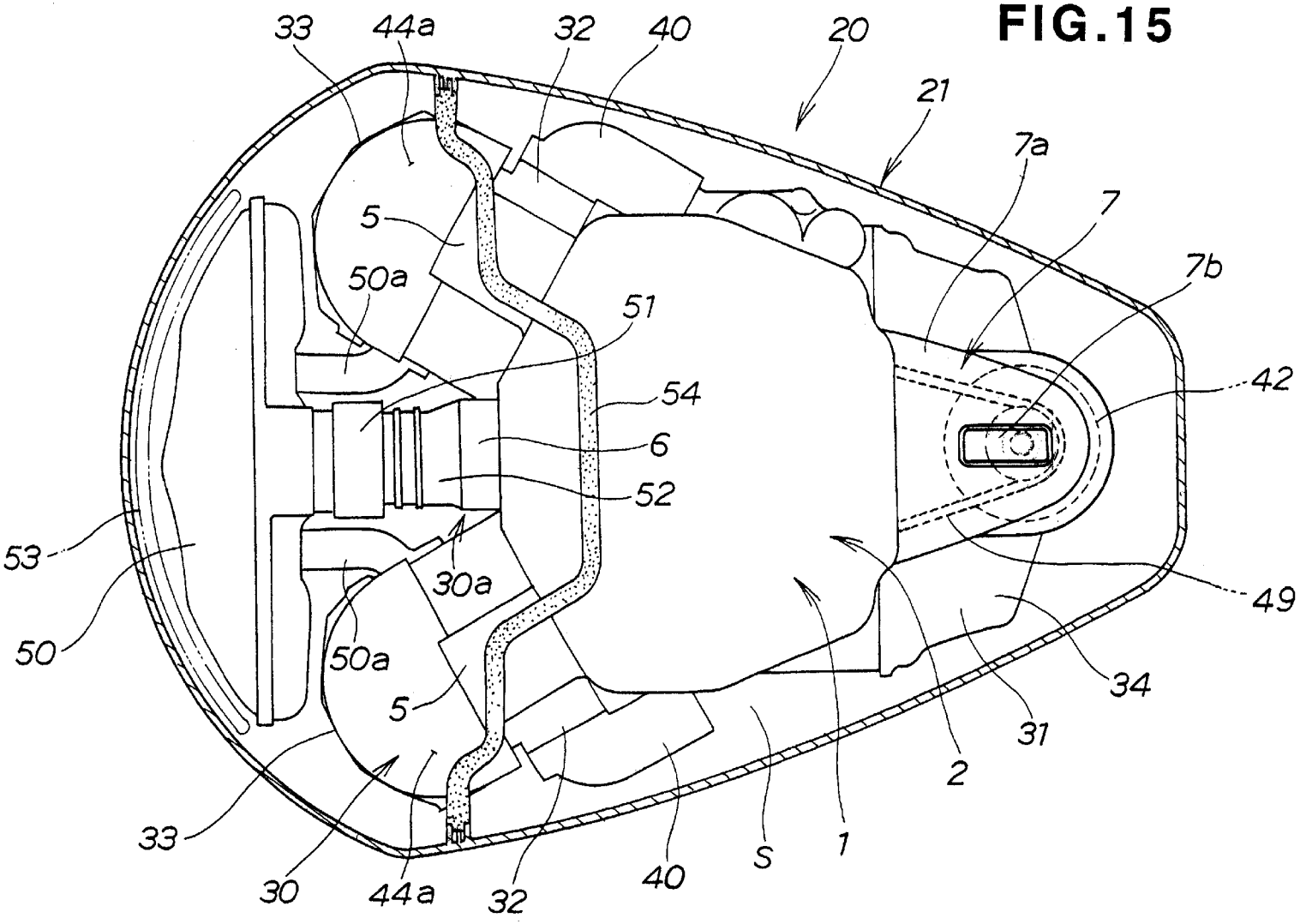
FIG. 15 is a plan view of an engine with an upper part of an engine cover of the outboard engine assembly cut away.

The engine 30 of the presently filed preferred embodiment shown in FIG. 14 has three cylinders 31*a* arrayed in a vertical direction, with the engine 30 being arranged in a V-type configuration, as viewed in a plane in FIG. 15, to form the four-stroke V-type six-cylinder vertical engine.

As shown in FIG. 15, a V-bank 30*a* of the cylinder block 31 is spread rearward. The air intake connecting duct 6 of the air intake muffler 1 is located inside the V-bank 30*a*. Also, the throttle valve unit 51 is located inside the V-bank 30*a*. The intake manifold 50 is located rearward of the spreading area of the V-bank 30*a*. An intake pipe 50*a* of each cylinder head 32 is located inside the V-bank 30*a*.

In the drawings, reference numeral 54 designates a seal member which partitions off the engine room S defined with the engine cover 21 to preclude heat generated by the cylinder heads 32, 32 from being transferred toward the electric power generator 42.

Figure 16:
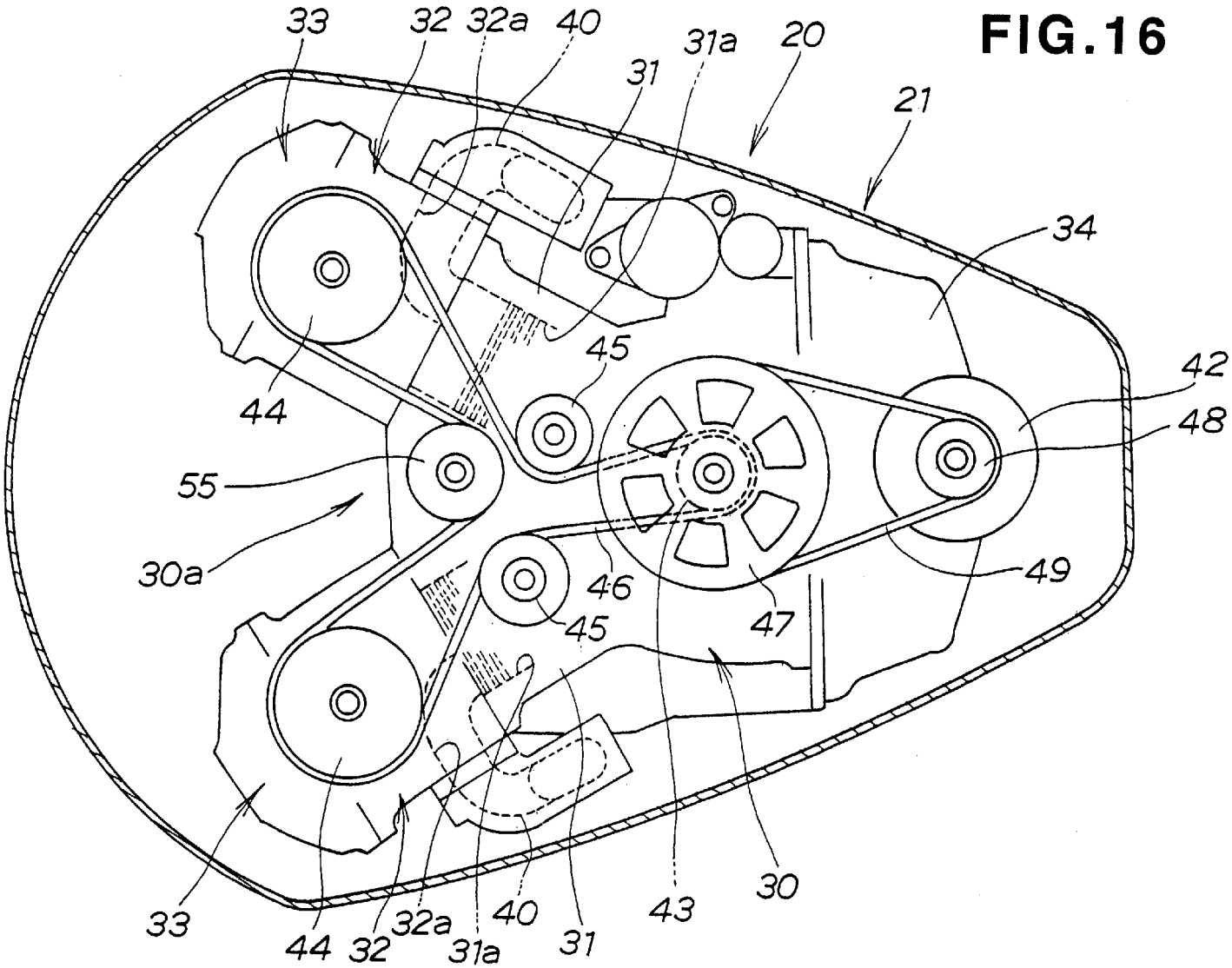
FIG. 16 illustrates an upper area of the engine with the air intake muffler and an intake system of FIG. 15 removed.

The exhaust manifold 40, which is connected to the exhaust ports 32*a*, 32*a* of the cylinder heads 32, 32 as shown in FIG. 16, extends downward in the engine room S as shown in FIG. 14 and is connected to the exhaust pipe 41. The exhaust pipe 41 is orientated downward and extends toward an area below the under cover 22 while passing through the under cover 22 and the extension case 23 to expel exhaust gases.

Figure 17:
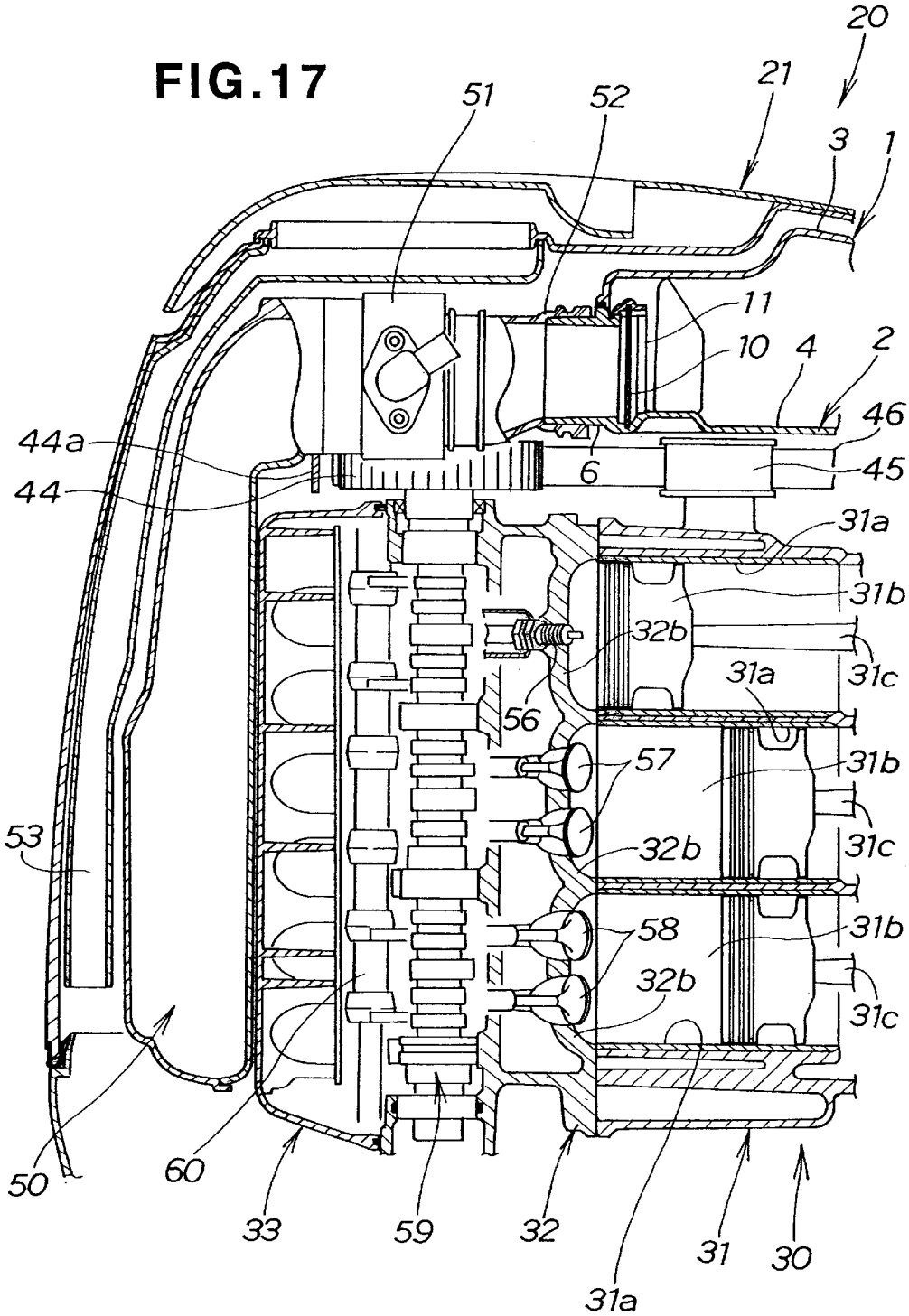
FIG. 17 is an enlarged longitudinal cross sectional view illustrating a relationship among the air intake muffler, a throttle valve unit and the engine.

As shown in FIG. 17, respective cylinders 31*a* arrayed in three rows in a vertical direction laterally accommodates therein pistons 31*b*, respectively. Transverse con-rods 31*c* are connected to the crankshaft 37.

The cylinders 31*a* have respective combustion chambers 32*b*. Each of the combustion chambers 32*b* is mounted with an ignition plug 56, two intake valves 57 and two exhaust valves 58.

The camshafts 59 are positioned rearward of the respective cylinder heads 32. The camshafts 59 are driven with the camshaft drive pulleys 44, respectively. A rocker arm shaft 60 is located at right and left sides of the camshafts 59 for supporting valve rocker arms for opening and closing the intake and exhaust ports 57, 58. The cylinder head cover 33 covers the camshaft 59 and the rocker arm shaft 60.

Figure 18:
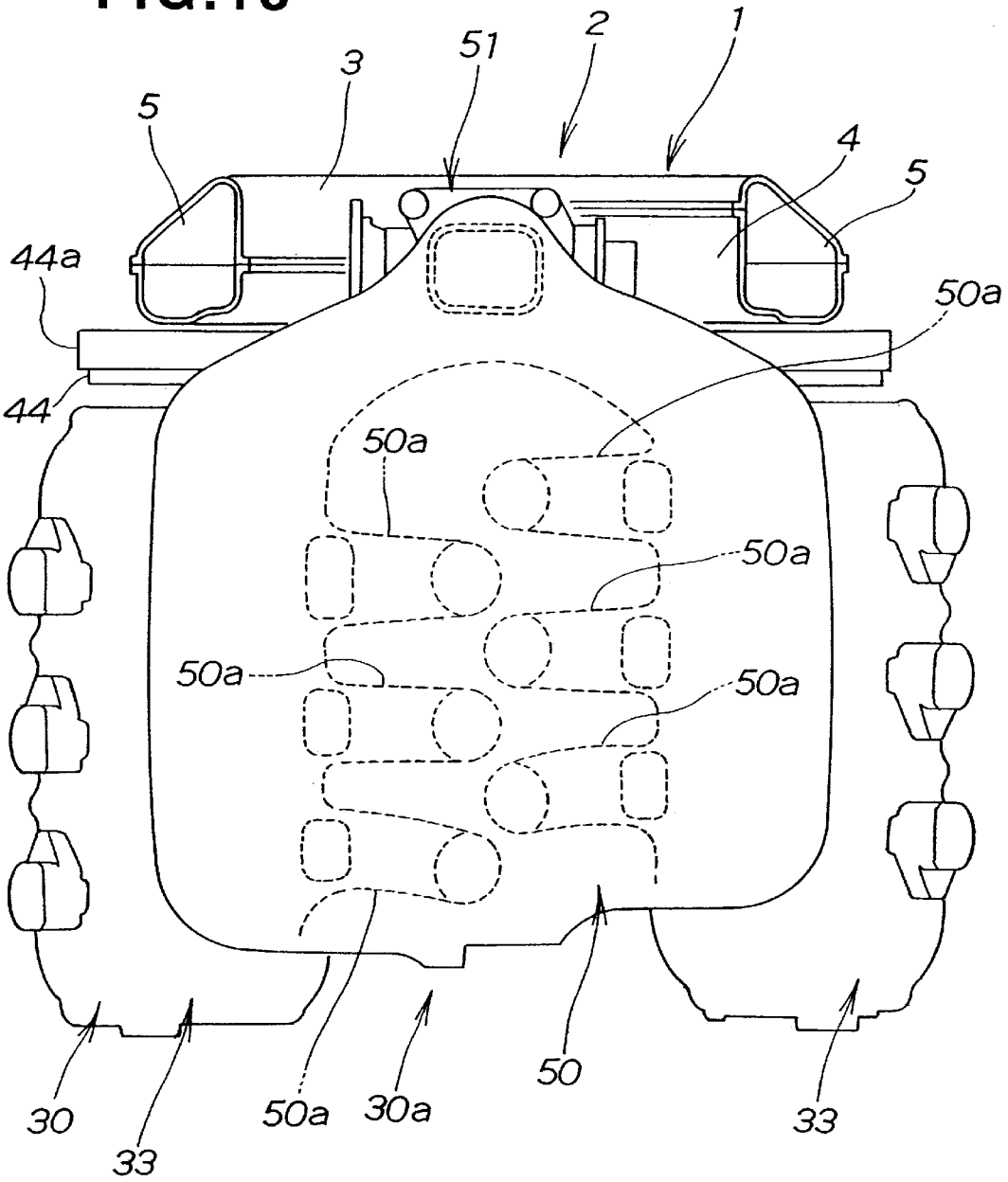
FIG. 18 is a rear view of an essential part of the engine involving an intake manifold.

As shown in FIG. 18, the intake manifold 50 has a large volume and is positioned at the area rearward of the V-bank 30*a* which expands rearward of the engine 30.

The intake manifold 50 is connected to the intake valves 57 of the respective cylinders 30*a* of the engine 30 via the right and left two rows each with three in the vertical direction, i.e. the sum of six exhaust pipes 50*a*. The intake manifold 50 is connected at its upstream to the throttle valve unit 51. The throttle valve unit 51 is connected to the air intake connecting duct 6 of the air intake muffler 1 via the grommet as previously noted. The air intake connecting duct 6 is mounted with the mesh member 11 which forms the flame arrester as described above.

Figure 19:
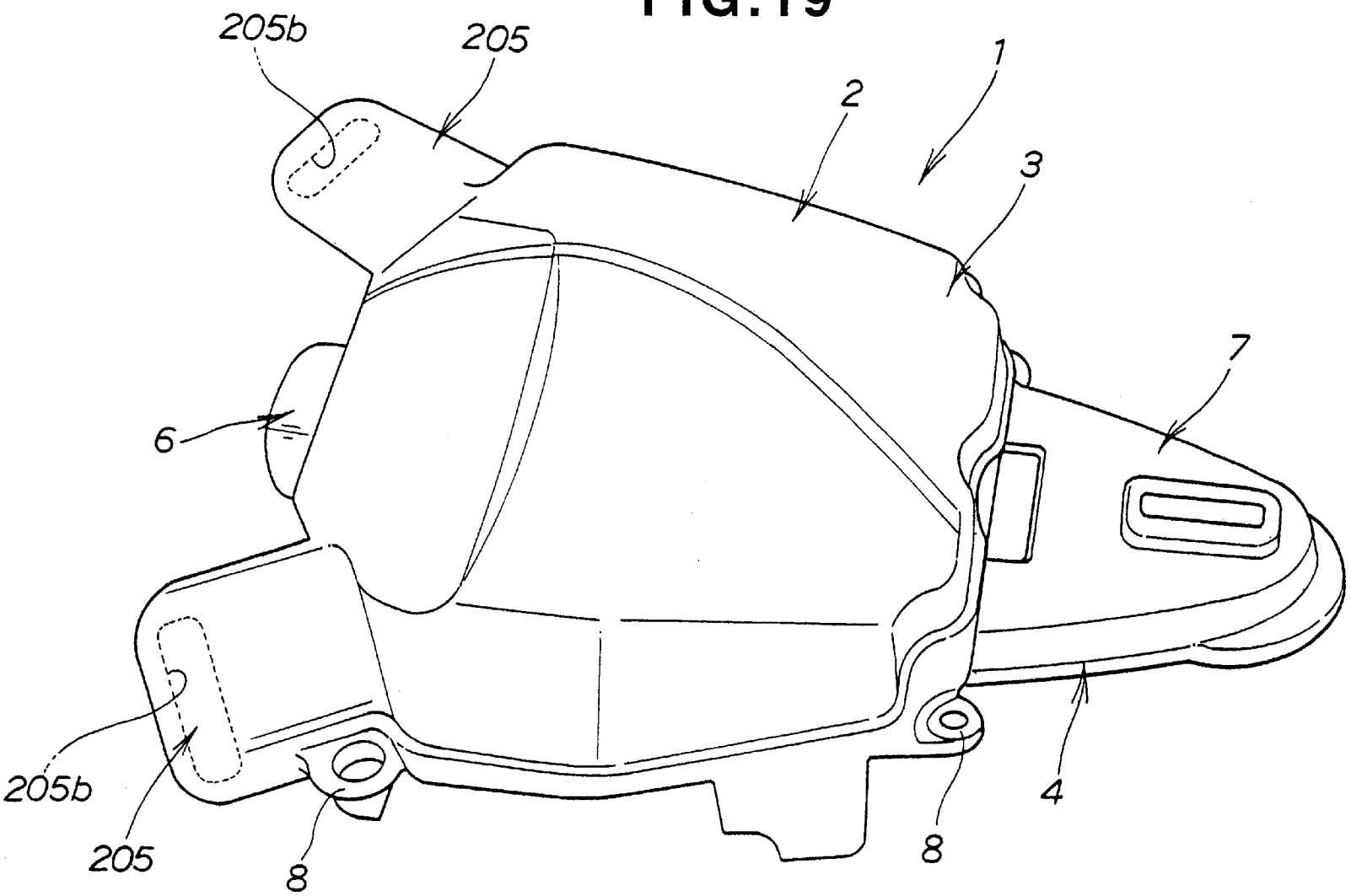
FIG. 19 is a perspective view of an air intake muffler according to a second embodiment of the present invention.
Figure 20:
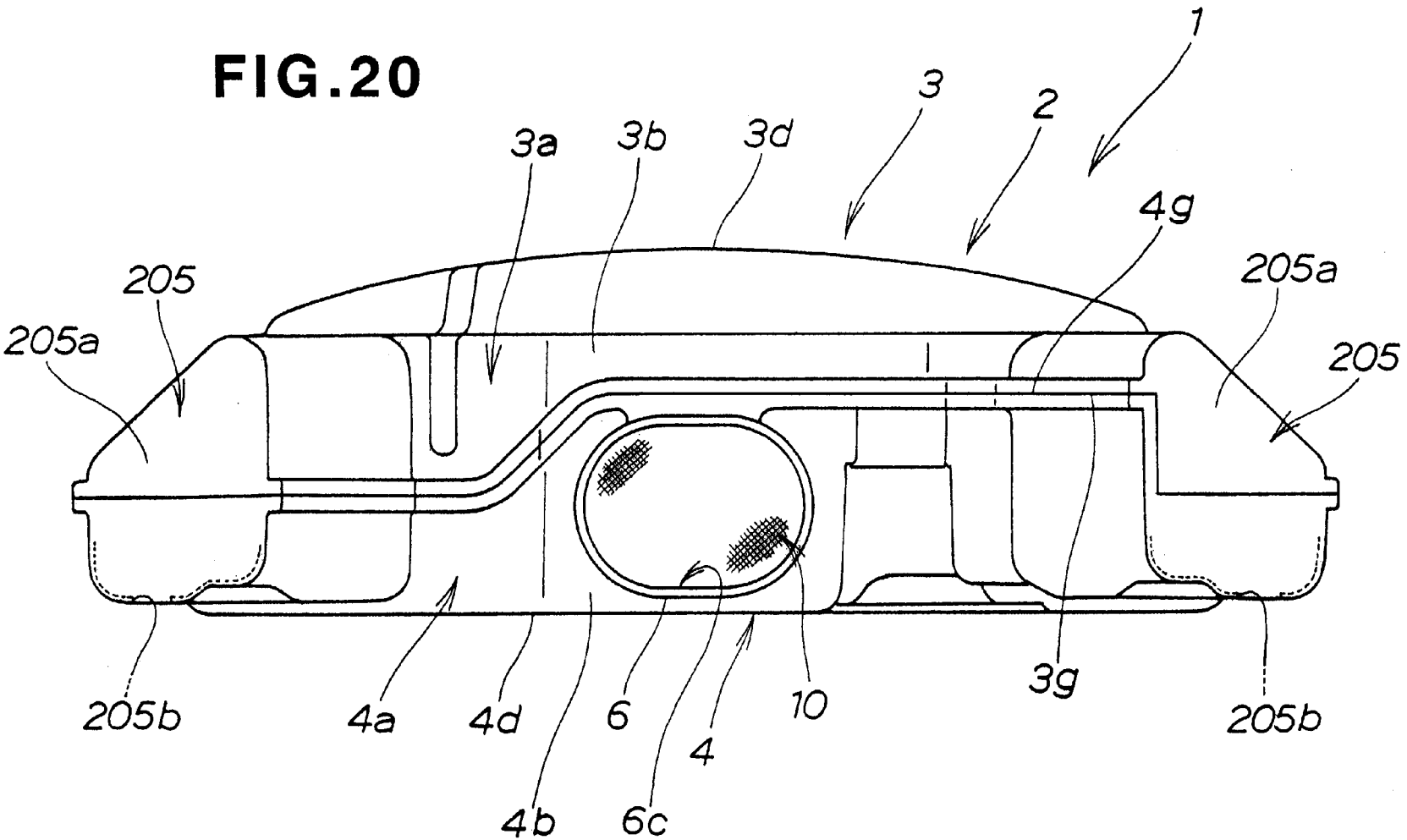
FIG. 20 is a front view of the air intake muffler shown in FIG. 19.

FIGS. 19 and 20 show the air intake muffler of a second preferred embodiment according to the present invention, with like parts bearing the same reference numerals as those of the first preferred embodiment to omit a description of the same.

As shown in FIG. 20, rear end walls 205*a*, 205*a* of outside air intake ducts 205, 205 are closed. The outside air intake ports 205*b*, 205*b* are formed to open downward at positions in the vicinities of rear distal ends of the outside air intake ducts 205, 205.

According to the present invention, as described in relation to the second preferred embodiment, the outside air intake ports 205*b*, 205*b* may be opened downwardly, sidewardly or upwardly, though not shown.

The present disclosure relates to the subject matters of Japanese Patent Application No. 2001-031904, filed Feb. 8, 2001, and Japanese Patent Application No. 2001-030826, filed Feb. 7, 2001, the disclosures of which are expressly incorporated herein by reference in their entireties.

What is claimed is:

1. An air intake muffler for introducing outside air to be fed to an air intake passage of a throttle valve unit of an engine, the air intake muffler comprising: an enclosure having a longitudinal axis, a first portion, and a second portion defining with the first portion an interior space of the enclosure; an air intake connecting duct for connection to an air intake passage of a throttle valve unit of an engine, the air intake connecting duct being formed unitarily with the first portion of the enclosure and extending outwardly from the interior space of the enclosure; and a pair of outside air intake ducts for introducing outside air into the interior space of the enclosure, the outside air intake ducts diverging in a V-shaped configuration from the longitudinal axis of the enclosure, and each of the outside air intake ducts having a pair of mating concave portions each formed unitarily with a respective one of the first and second portions of the enclosure and extending outwardly from the interior space of the enclosure.

2. An air intake muffler according to claim 1; wherein each of the air intake connecting duct and the outside air intake ducts extends along a corresponding axis disposed generally perpendicular to a preselected axis disposed generallty perpendicular to the longitudinal axis of the enclosure.

3. An air intake muffler according to claim 1; wherein the first portion of the enclosure has a retaining frame; and further comprising a flame arrester mounted in the retaining frame for preventing backfire of flames from entering the engine.

4. An air intake muffler according to claim 3; wherein the flame arrester is mounted in the retaining frame along a plane disposed generally perpendicular to an axis along which the air intake connecting duct extends.

5. An air intake muffler according to claim 3; wherein the flame arrester comprises a mesh member.

6. An outboard engine assembly comprising:

an engine having a throttle valve unit; and an air intake muffler disposed over the engine and comprised of an enclosure having a longitudinal axis and a pair of body portions connected together to define an interior space of the enclosure, an air intake connecting duct connected to an air intake passage of the throttle valve unit and formed unitarily with one of the body portions of the enclosure, and a pair of outside air intake ducts for introducing outside air into the interior space of the enclosure, the outside air intake ducts diverging in a V-shaped configuration from the longitudinal axis of the enclosure, and each of the outside air intake ducts having a pair of mating concave portions each formed unitarily with a respective one of the body portions of the enclosure.

7. An outboard engine assembly according to claim 6; wherein the engine comprises a V-type multi-cylinder vertical engine having a drive pulley, a belt entrained around the pulley, and a crankshaft for driving the drive pulley, the air intake muffler being disposed above the drive pulley and the belt.

8. An air intake muffler according to claim 6; wherein the air intake connecting duct and the outside air intake ducts extend outwardly from the interior space of the enclosure.

9. An air intake muffler for introducing outside air to be fed to an air intake passage of a throttle valve unit of an engine, the air intake muffler comprising: an enclosure having a pair of body portions connected together to define an interior space of the enclosure; at least one outside air intake duct integral with and projecting outwardly from the enclosure for introducing outside air into the interior space of the enclosure, the outside air intake duct having a pair of mating concave portions; and a connecting duct connectable with the air intake passage of the throttle valve unit of the engine for delivering the outside air from the interior space of the enclosure into the engine through the throttle valve unit, the connecting duct being integral with one of the body portions of the enclosure and projecting outwardly from the enclosure in a direction generally the same as a direction in which the outside air intake duct projects from the enclosure.

10. An air intake muffler according to claim 9; each of the mating concave portions is formed unitarily with a respective one of the body portions of the enclosure.

11. An air intake muffler according to claim 9; wherein the at least one outside air intake duct comprises two outside air intake ducts; and wherein the connecting duct is disposed between the two outside air intake ducts.

12. An air intake muffler according to claim 9; wherein the enclosure has a longitudinal axis; and wherein each of the connecting duct and the outside air intake duct extends along a corresponding axis disposed generally perpendicular to a preselected axis disposed generally perpendicular to the longitudinal axis of the enclosure.

13. An air intake muffler according to claim 12; wherein the at least one outside air intake duct comprises two outside air intake ducts; and wherein the connecting duct is disposed between the two outside air intake ducts.

14. An air intake muffler according to claim 9; wherein the enclosure has a longitudinal axis; and wherein the outside air intake duct has a closed outer end and an outside air intake port formed in the closed outer end and extending generally perpendicular to the longitudinal axis of the enclosure.

15. An air intake muffler according to claim 9; further comprising a retaining frame integral with one of the body portions of the enclosure and disposed upstream of the connecting duct, and a flame arrester supported by the retaining frame for preventing backfire of flames from entering the engine.

16. An air intake muffler according to claim 15; wherein the flame arrester comprises a mesh member having a peripheral edge portion; and wherein the retaining frame has a circumferential groove receiving the peripheral edge portion of the mesh member.

17. An air intake muffler according to claim 16, wherein the circumferential groove of the retaining frame is generally U-shaped.

18. An air intake muffler according to claim 17; further comprising a pressing member engaged with an upper part of the peripheral edge portion of the mesh member for retaining the mesh member in the circumferential groove of the retaining frame.

19. An air intake muffler according to claim 16; wherein each of the mesh member and the circumferential groove of the retaining member is tapered inwardly from an upper end to a lower end thereof.

20. An air intake muffler for introducing outside air to be fed to an air intake passage of a throttle valve unit of an engine the air intake muffler comprising: an enclosure having a pair of body portions connected together to define an interior space of the enclosure; at least one outside air intake duct integral with and projecting outwardly from the enclosure for introducing outside air into the interior space of the enclosure, the outside air intake duct having a pair of mating concave portions; a connecting duct connectable with the air intake passage of the throttle valve unit of the engine for delivering the outside air from the interior space of the enclosure and into the engine through the throttle valve unit, the connecting duct being integral with one of the body portions of the enclosure and projecting outwardly from the enclosure; a retaining frame integral with one of the body portions of the enclosure and disposed upstream of the connecting duct; and a flame arrester supported by the retaining frame for preventing backfire of flames from entering the engine.

21. An air intake muffler according to claim 20; wherein the flame arrester comprises a mesh member having a peripheral edge portion; and wherein the retaining frame has a circumferential groove receiving the peripheral edge portion of the mesh member.

22. An air intake muffler according to claim 21; wherein the circumferential groove of the retaining frame is generally U-shaped.

23. An air intake muffler according to claim 21; further comprising a pressing member engaged with an upper part of the peripheral edge portion of the mesh member for retaining the mesh member in the circumferential groove of the retaining frame.

24. An air intake muffler according to claim 23; wherein the circumferential groove of the retaining frame is generally U-shaped.

25. An air intake muffler according to claim 21; wherein each of the mesh member and the circumferential groove of the retaining member is tapered inwardly from an upper end to a lower end thereof.

26. An air intake muffler according to claim 25; wherein the circumferential groove of the retaining frame is generally U-shaped.

27. An outboard engine assembly comprising: a V-type multi-cylinder vertical engine having a throttle valve unit and at least two cylinders arranged in a V-shaped configuration; and an air intake muffler comprised of an enclosure having a pair of body portions connected together to define an interior space of the enclosure, at least two outside air intake ducts for introducing outside air into the interior space of the enclosure, and a connecting duct connected to the throttle valve unit of the engine for delivering the outside air from the interior space of the enclosure into the V-type multi-cylinder vertical engine through the throttle valve unit, the outside air intake ducts being integral with and projecting outwardly from the enclosure in a V-shaped configuration and disposed over the cylinders of the V-type multi-cylinder vertical engine, and the connecting duct being integral with one of the body portions of the enclosure and projecting outwardly from the enclosure in a direction generally the same as a direction in which the outside air intake duct projects from the enclosure.

28. An outboard engine assembly according to claim 27; wherein the connecting duct is disposed between the two outside air intake ducts.

29. An outboard engine assembly according to claim 27; wherein the air intake muffler has a retaining frame integral with one of the body portions of the enclosure, and a flame arrester supported by the retaining frame for preventing backfire of flames from entering the engine.

30. An outboard engine assembly according to claim 29; wherein the flame arrester comprises a mesh member having a peripheral edge portion; and wherein the retaining frame has a circumferential groove receiving the peripheral edge portion of the mesh member.

31. An outboard engine assembly according to claim 30; wherein the circumferential groove of the retaining frame is generally U-shaped.

* * * * *